US005546175A

United States Patent [19]

Uehara et al.

[11] Patent Number: 5,546,175

[45] Date of Patent: Aug. 13, 1996

[54] IMAGE FIXING DEVICE AND METHOD THEREOF

[75] Inventors: Yasuhiro Uehara; Yasuhiro Kusumoto; Yoshio Kanesawa, all of Nakai-machi; Toru Inoue, Ebina, all of Japan

[73] Assignee: Fuji Xerox Co., Ltd., Tokyo, Japan

[21] Appl. No.: 528,012

[22] Filed: Sep. 14, 1995

[30] Foreign Application Priority Data

Sep. 13, 1995 [JP] Japan ..... 7-259487

[51] Int. Cl.[6] ..... G03G 15/20

[52] U.S. Cl. ..... 355/290; 492/27

[58] Field of Search ..... 355/285, 290, 355/295; 100/162 B; 492/27; 226/184

[56] References Cited

U.S. PATENT DOCUMENTS 5,111,249 5/1992 Owada ..... 355/285

5,319,430 6/1994 DeBolt et al. ..... 355/290

FOREIGN PATENT DOCUMENTS 53-17740 2/1978 Japan .

2-230175 9/1990 Japan .

*Primary Examiner*—Nestor R. Ramirez

*Attorney, Agent, or Firm*—Oliff & Berridge

[57] ABSTRACT

The present invention provides an image fixing device for fixing toner on a transfer member comprises a heat roller which is a hollow cylindrical member rotatably supported at both end portions and having heating means inside thereof, pressure means press-contacted to the heat roller for pressing the transfer member passing between the heat roller and the pressure means against to a peripheral surface of the heat roller, and the pressure means is a pressure roller disposed approximately parallel to the heat roller and supported rotatably, at least one of the heat roller and the pressure roller has a layer of elastic material on its peripheral surface, and a value A/B is set to be within a range from 0.7 to 0.8 wherein A represents a nip width at an approximate central portion of an area between the heat roller and the pressure roller where the transfer member passes through and B represents a nip width at end portions of the area.

12 Claims, 5 Drawing Sheets

IMAGE FIXING DEVICE AND METHOD THEREOF

BACKGROUND OF THE INVENTION

1. Field of the Invention

The present invention relates to an image fixing device and a method thereof used in a machine employing the electrophotographic method such as a copying machine, facsimile apparatus or printer.

2. Discussion of the Related Art

In a copying machine, for example, which utilizes electrophotographic method, it is necessary to fix an unfixed toner image transferred on a recording sheet to form a permanent image, and therefore, fixing methods such as the vapor fixing, cold pressure fixing and heat fusing have been conventionally used for permanent image formation. However, when the vapor fixing method is employed, a solvent vaporizes and diffuses, which causes an unpleasant odor. The cold pressure fixing method is inferior to other methods in fixing capability, and besides, there is an economic problem such that the cold pressure fixing requires to use expensive pressure sensitive toner, for example, capsule toner. So, both cold pressure fixing and vapor fixing are not used so widely at present.

Accordingly, heat fusing method, which melts the toner by heating and fuses it to the surface of the recording sheet, is widely employed in fixing an unfixed toner image. There are various types of heat fusing device which bring the heat fusing method into practice, and in particular, the device employing a heat roller method is generally used. As shown in FIG. 1, the device of such type comprises a heat roller 1 and a pressure roller (pressure applying means) 2. The heat roller 1 comprises a metal cylindrical core 3, a heater 4 such as an infrared ray lamp provided inside of the metal cylindrical core 3 and a releasing layer 5 covering the peripheral surface of the metal cylindrical core 3. The releasing layer 5 is formed on purpose to prevent attachment of toner, which has transferred from the surface of the recording sheet, to the peripheral surface of the core 3 and is made of heat-resisting material such as fluororesin, silicone rubber or silicone resin. For example, in a small-sized copying machine, the core 3 is a cylinder made of material such as aluminum, aluminum alloy, copper or copper alloy, and the diameter of which is 20 mm to 40 mm, thickness is 0.5 mm to 3 mm. The core 3 is coated with fluororesin as a releasing layer 5 whose thickness is 20 μm to 100 μm.

The pressure roller 2 is disposed to press-contact the heat roller 1 and apply pressure thereto, and comprises a core 6 and a releasing layer 7 made of heat-resisting rubber and coating the peripheral surface of the core 6 to improve paper stripping capability. As the heat-resisting rubber, for example, silicone rubber or fluororubber can be used. By rotating the heat roller 1 and pressure roller 2, a recording sheet 9 on which an unfixed toner image 8 is formed is passed through a nip area between the heat roller 1 and pressure roller 2, where the heat and pressure are applied to the recording sheet 9 to fix the toner image 8.

In comparison with other heat fusing methods, such as radiant fusing or oven fusing, the heat efficiency of the heat roller method is higher; consequently, a smaller amount of electric power is consumed and high-speed fixing can be performed. Even if the recording sheets are jammed, temperature can be controlled with ease so that the temperature of the recording sheet is not extremely higher than that of the heat roller. Accordingly, since there is little possibility of causing a fire, the heat roller method is moreover advantageous and is most widely used at present.

The fixing device employing the heat roller method has a problem that wrinkling is apt to be generated on the recording sheet 9 when the sheet passes through a nip between the roller 1 and roller 2. To resolve the problem, a heat roller 1 with a gradient on its peripheral surface, for example, a heat roller 1 with the diameter of the central portion smaller than that of the end portions by 30 μm to 200 μm, approximately (hereinafter referred to this heat roller as a reversed crown roller), has been conventionally used. Use of the reversed crown roller generates difference in carrying speed of the recording sheet in the direction of width of the recording sheet, whereby the recording sheet is pulled in the direction of both ends and generation of wrinkling can be prevented.

Generally, to manufacture the reversed crown roller, first the core 3 is plastically deformed by extruding a bar or pipe, and is cut in plural rollers having a predetermined length. Then the peripheral surface of the core 3 is formed in a shape of reversed crown by cutting work by lathing or by centerless polishing, and is coated with the releasing layer 5. However, there has been a problem that accuracy is required in forming the core 3 in the shape of reversed crown so that the generation of wrinkling on the recording sheet 9 is prevented; therefore, the cost increases. To reduce the cost of manufacturing the heat roller 1, inventors of the present invention has studied to prevent occurrence of wrinkling on the recording sheet 9 while using a roller having a uniform diameter over the longitudinal direction.

In carrying out the cutting work on the core 3 to form into the shape of the reversed crown, accuracy is required, and as a result the peripheral surface of the core 3 is finished to be almost a mirror surface. Therefore, despite the releasing layer 5 formed on the peripheral surface of the core 3, there is a fear that the releasing layer is debonded from the core 3 because the adhesive force between the core 3 and the releasing layer 5 is weakened though the life of the releasing layer still remains. Conventionally, to prevent debonding of the releasing layer, the peripheral surface of the core 3 is roughened, for example, by sand blasting on purpose to increase the mechanical coupling force (anchor effect) by increase of area which contacts the releasing layer.

If the roller having uniform diameter over the longitudinal direction for which the inventors are seeking is realized, the core 3 having uniform diameter over the longitudinal direction which is made by extruding alone may be used; therefore polishing for forming the core 3 into the shape of reversed crown is unnecessary. However, since the surface of the core 3 after extruding is also like a mirror surface, the adhesive force between the core 3 and the releasing layer 5 should be improved by the surface roughening process which is complicated and expensive to prevent alebonding of the releasing layer 5 from the core 3 before expiration of life of the releasing layer 5.

As another factor causing debonding of the releasing layer 5 from the core 3, not only roughness of the surface of the core 3, but also the influence of the pressure applied to the nip can be considered. That is, repeat of application of the pressure to the nip makes the releasing layer 5 wearing. Besides, since there is a fear that coating the core 3 with the releasing layer 5 is insufficient to prevent fusing of toner 8 from the recording sheet 9 to the heat roller 1, the releasing agent is supplied to the surface of the releasing layer 5. Silicone oil, mainly used as the releasing agent, infiltrates into pinholes, slight scratches or cracks, thus gradually reducing the adhesive force between the releasing layer 5 and the core 3. Moreover, a stripper finger has been conventionally used for stripping the recording sheet 9 from the heat roller 1 compulsorily. Such stripper finger always scratches the releasing layer 5 with its sharp point, whereby generation of the scratches or cracks and wear of the releasing layer 5 is accelerated, and accordingly the deterioration of the releasing layer 5 is induced. This wear or deterioration has been the cause of debonding of the releasing layer 5 from the core 3.

SUMMARY OF THE INVENTION

The present invention has been made in view of the above circumstances and has as an object of provision of an image fixing device capable of preventing occurrence of wrinkling in a recording sheet while a heat roller with a uniform outer diameter over the longitudinal direction is used.

Another object of the present invention is to provide an image fixing method, in the case where a heat roller comprising a core having a uniform outer diameter and a releasing layer is used as the heat roller having uniform outer diameter, which prevents debonding of the releasing layer from the core before expiration of life of the releasing layer without executing a surface roughening process on the core which is expensive and requires much labor.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims. To achieve the objects and in accordance with the purpose of the invention, as embodied and broadly described herein, an image fixing device of the present invention comprises a heat roller which is a hollow cylindrical member rotatably supported at both end portions and having heating means inside thereof, pressure means press-contacted to the heat roller for pressing the transfer member passing between the heat roller and the pressure means against to a peripheral surface of the heat roller, and the pressure means is a pressure roller disposed approximately parallel to the heat roller and supported rotatably, at least one of the heat roller and the pressure roller has a layer of elastic material on its peripheral surface, and a value A/B is set to be within a range from 0.7 to 0.8 wherein A represents a nip width at an approximate central portion of an area between the heat roller and the pressure roller where the transfer member passes through and B represents a nip width at end portions of the area.

BRIEF DESCRIPTION OF THE DRAWINGS

The accompanying drawings, which are incorporated in and constitute a part of this specification illustrate embodiment of the invention and, together with the description, serve to explain the objects, advantages and principles of the invention. In the drawings.

DETAILED DESCRIPTION OF THE PREFERRED EMBODIMENT

Figure 2:
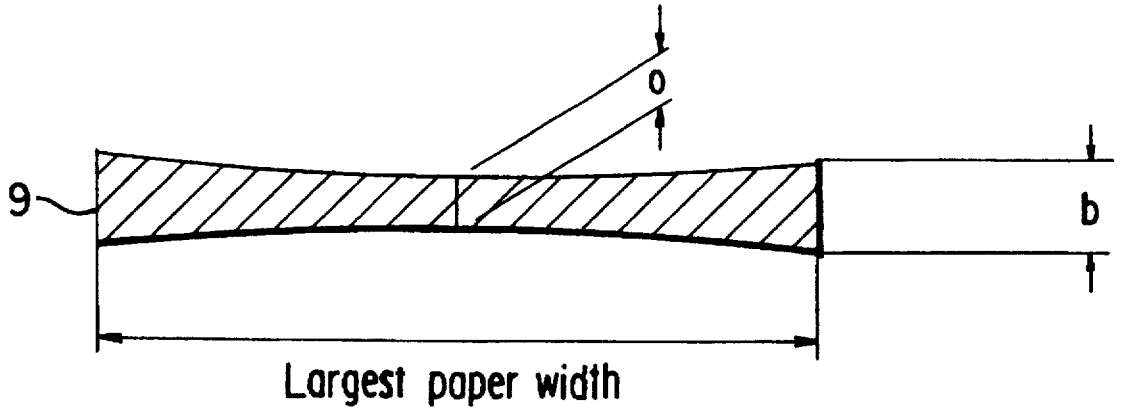
FIG. 2 shows a nip area of the first embodiment of the image fixing device according to the present invention.

The inventors of the present invention has made experiments on occurrence of wrinkling in a recording sheet using a heat roller with a uniform outer diameter over the longitudinal direction (hereinafter, referred to as a roller having uniform outer diameter). As a result, shape of a contact area (hereinafter referred to as a nip area) between the recording sheet and the heat roller is an important factor in occurrence of wrinkling in the recording sheet in the case where the heat roller is comparatively short, for example, width of supplied recording sheet is not more than 220 mm. That is, the shape of the nip area can be represented by a nip area shape index C as follows:

$$C=A/B$$

wherein A is the width of the nip area (a spacing between the heat roller 1 and pressure applying means 2) at the central portion, and B is the width of the nip area at both ends of the widest recording sheet which passes the nip area as shown in FIG. 2. Normally, the heat roller is bent by the load, and accordingly the nip area shape index C is smaller than 1.

Taking bending of both rollers into consideration, the nip area shape index C for a roller with a uniform outer diameter is determined based on the length of the heat roller, the load between the heat roller and pressure applying means, and rigidity of the heat roller and the pressure applying means. That is, even in the case of the roller having the same length and rigidity, the nip area shape index C becomes smaller as the load increases. If the length of the roller is fixed and the same load is applied, the nip area shape index C becomes larger as the rigidity of the roller increases. Even if the load and the rigidity of the roller are fixed, the degree of bending of the roller becomes higher as the length of the roller increases, thus decreasing the nip area shape index C. According to the above description, the nip area shape index C is approximately in proportion to EI/W (the roller rigidity) on condition that the length of the roller is fixed, wherein W is the load, E is Young's modulus of material of the core of the roller, I is the second moment of area of the roller and EI represents flexural rigidity of the roller.

Moreover, in the case of a comparatively short heat roller, the inventors have examined the rate of occurrence of wrinkling in the recording sheet on condition that the rigidity of the heat roller and the load are changed. As a result, it has been found that there is close relation between occurrence of wrinkling and the nip area shape index C, that is, occurrence of wrinkling can be prevented if the value of C is 0.7 to 0.8.

That is, if the nip area shape index C exceeds 0.8, effect of restraining of wrinkling occurrence according to difference between the recording sheet carrying speed at the central portion of the roller and that at the end portions of the roller. If the nip area shape index C is less than 0.7, phenomenon of increasing of wrinkling occurrence caused by the nip pressure is larger than the effect of reduction of wrinkling occurrence according to the difference in the recording sheet carrying speed.

In the case a core having the uniform outer diameter with a releasing layer on its peripheral surface is used as the roller having the uniform outer diameter, if the roughening process is not provided, there is a fear that the releasing layer formed on the peripheral surface of the core will be debonded therefrom. However, according to the experiment made by the inventors, if the heat roller and the pressure applying means are press-contacted against to each other with the load of 5 kgf or less, fatigue of the releasing layer can be reduced; therefore, the releasing layer is not debonded from the core before the life of the releasing layer expires. Further, the use of the oilless toner in forming a toner image resolves the fear that the toner fuses to the heat roller; accordingly, use of the conventional releasing agent is unnecessary, and moreover, the conventional stripper finger also becomes unnecessary because it is easy to strip the recording sheet from the heat roller. Consequently, deterioration of the releasing layer can be prevented, and furthermore the releasing layer is hard to be debonded from the core.

First Embodiment

Figure 1:
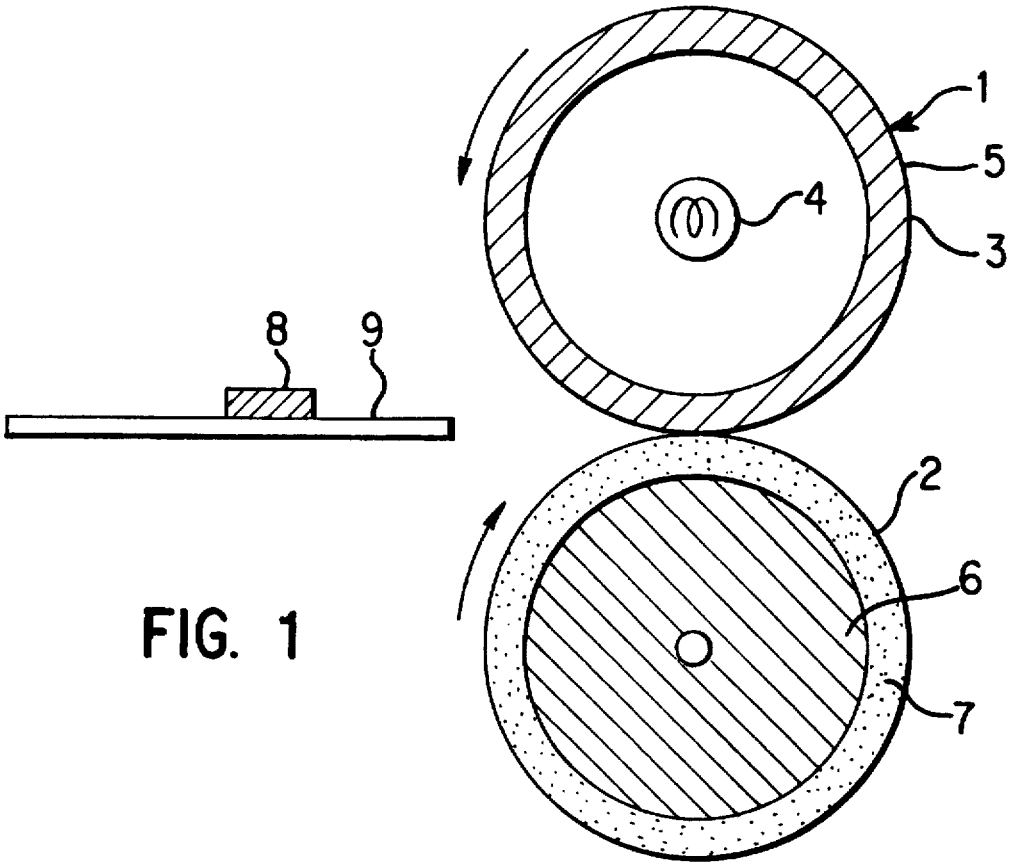
FIG. 1 is a sectional side elevation view showing a first embodiment of an image fixing device according to the present invention.

Preferred embodiment of an image fixing device according to the present invention is now described in detail based on the drawings. The basic construction of this embodiment of the image fixing device is the same as that of the conventional image fixing device shown in FIG. 1; therefore explanation is omitted. A heat roller 1 used here is made by coating the surface of a core 3 made of aluminum having the diameter of 20 mm and length of 245 mm with fluororesin of 35 μm thickness over 220 mm length in the longitudinal direction. The core 3 is a cylinder having uniform outer diameter made by extruding and plastic forming of a bar or pipe. Various dies for the extruding process are used here, and thereby 6 types of core 3 having different thicknesses ranging from 0.7 mm to 2.5 mm as shown in Table 1 below are formed. No special process is provided to the surface of the core 3 after extruding, and the value of 10 point average roughness Rz of the surface is 0.1 μm to 0.4 μm, which is almost like a mirror surface.

TABLE 1

| Load (kgf) | Thickness (mm) | Nip area shape index C | Occurrence of wrinkling | The number of recording sheets at which releasing layer begins to be debonded |
|---|---|---|---|---|
| 2.5 | 0.7 | 0.75 | ** | |
| | 1.0 | 0.78 | ** | 80,000 (Oil is used as releasing agent) |
| | 1.3 | 0.80 | * | |
| | 1.7 | 0.83 | * | |
| | 2.0 | 0.86 | * | |
| | 2.5 | 0.90 | * | |

TABLE 1-continued

| Load (kgf) | Thickness (mm) | Nip area shape index C | Occurrence of wrinkling | The number of recording sheets at which releasing layer begins to be debonded |
|---|---|---|---|---|
| 5.0 | 0.7 | 0.73 | *** | |
| | 1.0 | 0.74 | *** | |
| | 1.3 | 0.77 | *** | 100,000 (Oilless toner is used) |
| | 1.7 | 0.81 | *** | |
| | 2.0 | 0.83 | ** | |
| | 2.5 | 0.85 | * | |
| 8.0 | 0.7 | 0.61 | * | |
| | 1.0 | 0.65 | ** | |
| | 1.3 | 0.70 | *** | |
| | 1.7 | 0.70 | *** | |
| | 2.0 | 0.74 | *** | |
| | 2.5 | 0.75 | *** | |

Primer is coated on the peripheral surfaces of these cores 3, and after that fluororesin powder, a mixture of PFA (perfluoroalkoxy) with 5–10 percent by weight of silicone carbide is applied to electrostatic coating, and then fired in the oven of 400° C. for 2 hours, thus forming the releasing layer 5. After firing, the surface of the releasing layer 5 is polished by polishing cloth to complete the heat roller 1. That is, the heat roller 1 is formed by directly coating fluororesin on the smooth peripheral surface of the core 3, without the sand blasting roughening process on the peripheral surface of the core 3, which is made of aluminum and having uniform outer diameter.

A pressure roller 2 is made by coating a core 6 which is cylindrical and made of iron with silicone rubber as a releasing layer 7. The diameter of the core 6 is 13 mm, the length is 260 mm, and the releasing layer of the thickness of 3.5 mm is formed on the surface of the core 6 over 220 mm in the longitudinal direction. Because the heat roller 1 and the pressure roller 2 are deformed when they are pressed against to each other, the nip area shape index C corresponding to the pressure load can be obtained. The nip area shape index C can be represented by the equality C=A/B, wherein A means the nip width (spacing between the heat roller 1 and the pressure roller 2) at the central portion of the area where the recording sheet 9 having the largest acceptable width passes, B means the nip width at both end portions of the area where the recording sheet having the largest acceptable width passes. In this embodiment, 6 types of the heat roller 1 described above and the pressure roller 2 are pressed against to each other with the load of 2.5, 5.0 and 8.0 kgf, and the nip area shape index C is measured in each case. The result is shown in Table 1. The press-contact forces caused by the above-described loads converted into the amount per unit length in the direction of axis of the heat roller are 0.11 kg/cm, 0.23 kg/cm and 0.37 kg/cm, respectively.

Moreover, an experiment has been carried out to examine the relation between the nip area shape index C and the rate of occurrence of wrinkling in the recording sheet 9 with variation of the load. Here, the rate of occurrence of wrinkling means a value obtained by dividing the number of recording sheets 9 (L-series A4 size paper manufactured by Fuji Xerox Co., Ltd.) in which wrinkling occurs by the total number of recording sheets which passed the nip area, namely 60. The above-described recording sheets 9 are left by twenties in three different environments for a whole day and night. Here, three different environments are: an environment of low temperature and low humidity (room temperature: 10° C., humidity: 30%), an environment of middle temperature and middle humidity (room temperature: 20°

C., humidity: 60%) and an environment of high temperature and high humidity (room temperature 28° C., humidity: 85% ). The recording sheets 9 pass through in the direction such that the shorter edge of the sheet is parallel to the center axis of the heat roller 1.

The result of the experiment is shown in Table 1, wherein * means high rate of occurrence of wrinkling, that is, the rate is 10/60 or more,  means that the rate of occurrence of wrinkling ranges from 1/60 to 9/60, and * means no wrinkling occurs. As shown in this table, as the thickness of the heat roller reduces, that is, the flexural rigidity reduces, the nip area shape index C also reduces on condition that the press-contact force is constant. This is caused by increase of the degree of bending of the heat roller in accordance with reduction of the flexural rigidity. The value of the nip area shape index C becomes smaller by increase of the press-contact force. This is because the degree of bending of the heat roller becomes larger as the press-contact force increases.

From the relation between the value of the nip area shape index C which is changed by variation of the flexural rigidity of the heat roller and press-contact force and the occurrence of wrinkling, it can be seen that there is little occurrence of wrinkling if the nip area shape index C is approximately within the range from 0.7 to 0.8.

In the case of the press-contact force is 2.5 kg, the occurrence of wrinkling is not practically sufficient though the value of the nip area shape index C ranges from 0.7 to 0.8, but it is understood that the occurrence of wrinkling is tend to be more restrained in the case where the nip area shape index C is within the above range than in the case where the index C is not within the above range.

Next, an experiment taking the influence caused by difference of the heat roller diameter into consideration will be explained.

In this experiment, heat rollers whose core outer diameters are 15 mm, 20 mm and 25 mm are used. Some of these cores of the heat rollers are made of aluminum (A5052) and others are made of steel. They are cylindrical members having uniform outer diameters and length of 245 mm, and their flexural rigidities can be determined to be within the range from 13.5 kg·mm$^2$ to 41.0 kg·mm$^2$ by selecting appropriate thicknesses. The outer diameters, flexural rigidities and thicknesses of the above cores are shown in Table 2.

TABLE 2

| Outer Diameter of the Core | Flexural Rigidity | Thickness of the Core [mm] | |
|---|---|---|---|
| [mm] | [kg · mm] | Aluminum | Steel |
| 15 | $18.5 \times 10^6$ | 2.5 | 0.55 |
| | $20.5 \times 10^6$ | — | 0.87 |
| | $27.0 \times 10^6$ | — | 1.26 |
| | $34.0 \times 10^6$ | — | 1.74 |
| | $41.0 \times 10^6$ | — | 2.38 |
| 20 | $18.5 \times 10^6$ | 0.7 | 0.21 |
| | $20.5 \times 10^6$ | 1.1 | 0.32 |
| | $27.0 \times 10^6$ | 1.6 | 0.44 |
| | $34.0 \times 10^6$ | 2.2 | 0.56 |
| | $41.0 \times 10^6$ | 3.0 | 0.69 |
| 25 | $18.5 \times 10^6$ | 0.34 | — |
| | $20.5 \times 10^6$ | 0.52 | 0.16 |
| | $27.0 \times 10^6$ | 0.71 | 0.22 |
| | $34.0 \times 10^6$ | 0.91 | 0.27 |
| | $41.0 \times 10^6$ | 1.12 | 0.33 |

These heat rollers are manufactured in the same process as that of the heat rollers used in the previous experiment. The pressure roller used in this experiment is a cylindrical core made of steel coated with silicone elastic material (silicone sponge type) of 5 mm as the releasing layer. The outer diameter of the core is 18 mm and the length is 260 mm.

By using such heat rollers and pressure roller, an experiment of toner image fixing is carried out in which the press-contact force between the heat roller and the pressure roller is changed into three degrees, namely, 3 kgf, 5 kgf and 8 kgf. The recording sheets used in this experiment are the same as those used in the previous experiment, and also left in three different environments for a whole day and night. The recording sheets are left in each environment by eighties, and 240 sheets of paper, in total, are passed through the nip area to carry out toner image fixing.

Figure 3:
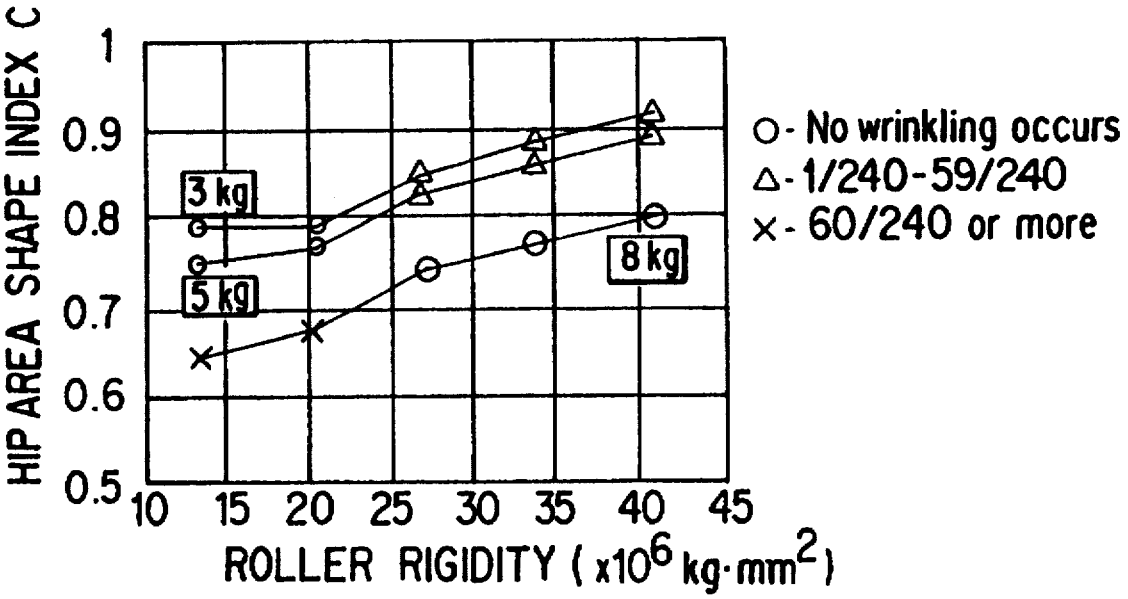
FIG. 3 shows a relation among the flexural rigidity of the heat roller, the press-contact force and a nip area shape index C and a relation between the nip area shape index C and the rate of occurrence of wrinkling in the case where the heat roller of 15 mm outer diameter is used.
Figure 4:
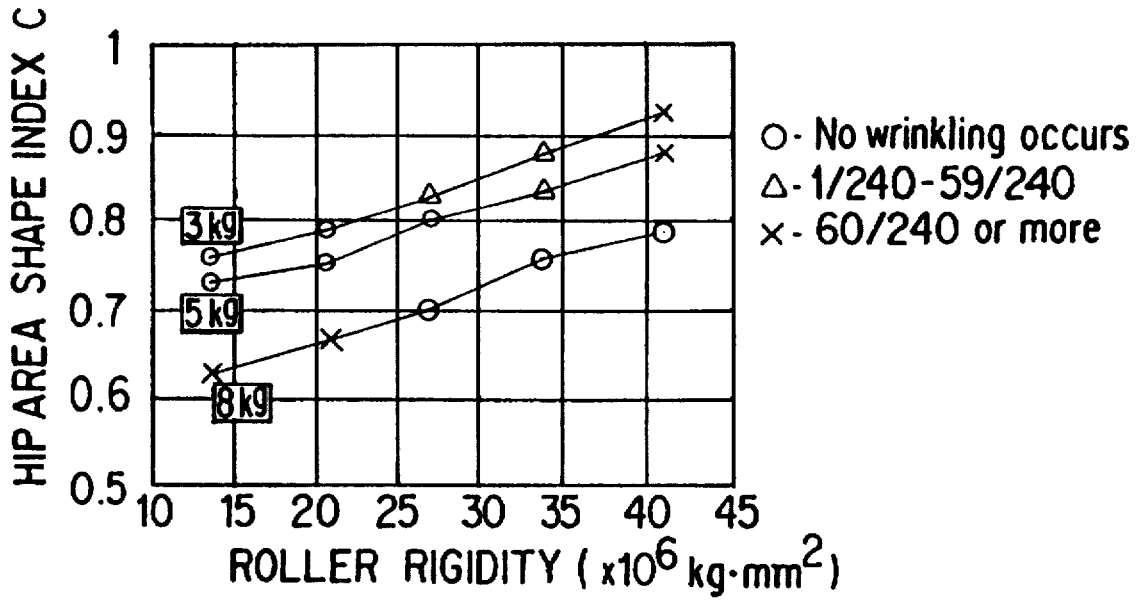
FIG. 4 shows a relation among the flexural rigidity of the heat roller, the press-contact force and the nip area shape index C and a relation between the nip area shape index C and the rate of occurrence of wrinkling in the case where the heat roller of 20 mm outer diameter is used.
Figure 5:
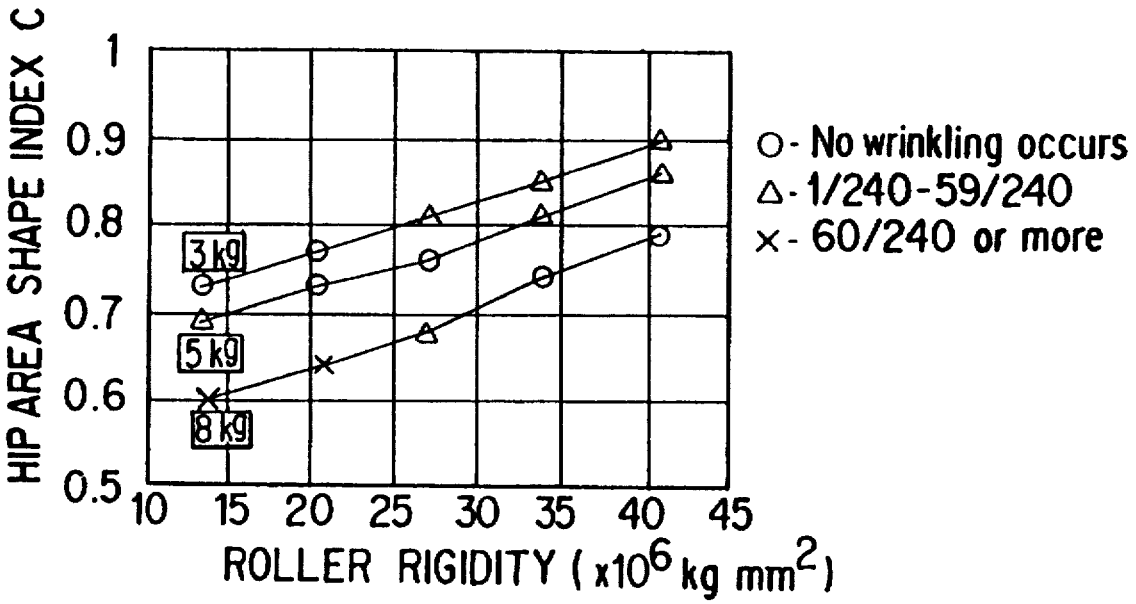
FIG. 5 shows a relation among the flexural rigidity of the heat roller, the press-contact force and the nip area shape index C and a relation between the nip area shape index C and the rate of occurrence of wrinkling in the case where the heat roller of 25 mm outer diameter is used.

The results of the experiment are shown in FIGS. 3–5. FIG. 3 shows relation between the nip area shape index C and rigidity of the heat roller, the nip area shape index C and the state of occurrence of wrinkling in the case of the heat roller having 15 mm outer diameter. FIGS. 4 and 5 show the results of the cases of the heat rollers having outer diameters of 20 mm and 25 mm, respectively. In these figures, the mark X indicates that the rate of occurrence of wrinkling is high, not less than 60/240, the mark Δ indicates that the rate of occurrence of wrinkling ranges from 1/240 to 59/240, and the mark ○ indicates that no wrinkling occurs.

As shown in these figures, though the press-contact force is fixed to be a predetermined value, the nip area shape index becomes smaller as the outer diameter of the heat roller increases. If the press-contact force becomes larger, the nip area shape index is reduced. Little or no wrinkling occurs when the nip area shape index is approximately within the range from 0.7 to 0.8 while the press-contact force may be any of 3 kgf, 5 kgf and 8 kgf.

Figure 6:
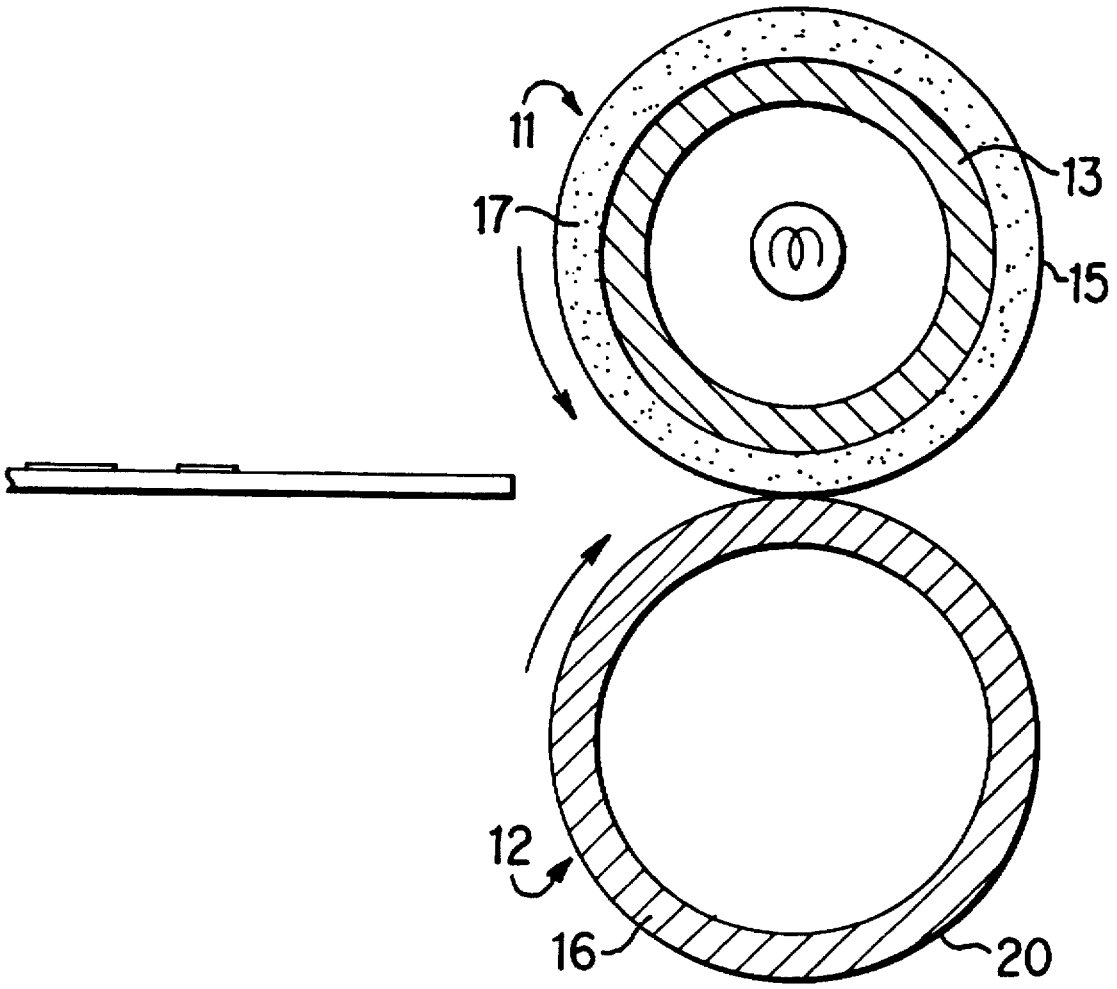
FIG. 6 is a schematic construction view showing a variation of the image fixing device shown in FIG. 1.

In the embodiment described here, the heat roller has the releasing layer on the peripheral surface of the core and the pressure roller has the elastic material layer on its peripheral surface. However, a similar effect can be obtained by using a heat roller 11 as shown in FIG. 6, which comprises a metal core 13 and an elastic material layer 17 around thereof, and further a releasing layer 15 thereon. In this case, a pressure roller 12 whose surface and vicinity are hard to be deformed, for example, a core 16 coated with a thin surface layer 20, should be used.

Next, an experiment is carried out to compare the adhesive force of releasing layer 5 between the cases of rough surface of the core 2 and smooth surface of the core 2. The result is shown in Table 3 below.

TABLE 3

| Roughness of the surface of sample (μm) | Adhesive force of fluororesin (kgf) |
|---|---|
| 0.2 | 0.9 |
| 1.0 | 1.2 |
| 4.0 | 1.8 |

In this experiment, the surface of the aluminum sample, which is material of the core 2, is coated with a fluororesin film (material of the releasing layer 5) of length of 25.4 mm, and then the film is pulled in the direction vertical to the surface of the sample to measure the force by which the film is debonded from the surface. Hereinafter, the force is referred to as the adhesive force. As it is clear from the table, the adhesive force in the case the surface roughness of the sample (10 point average roughness Rz) is 4 μm is twice as large as the adhesive force in the case the surface roughness is 2 μm, that is, the surface is almost like a mirror surface.

As described above, the surface roughness (Rz) of the core 3 in this embodiment is 0.1 μm to 0.4 μm, and on the other hand, the surface roughness (Rz) of the conventional core processed with sand blasting is 2.0 μm to 8.0 μm; therefore, the adhesive force in the case the surface of the core 3 in this embodiment is considered to be decreased to about half of that of the conventional core.

However, in this embodiment, trouble of debonding of the releasing layer 5 does not occur when an experiment is carried out on condition that the core 3 having 1.3 mm thickness as the heat roller 1 is used, the load applied between the heat roller 1 and the pressure roller 2 is set to be 5 kgf, and 100,000 recording sheets 9 are passed through the nip area. The number of recording sheets, 100,000, corresponds to the number of recording sheets at the time the life of the releasing layer 5 made of fluororesin practically expires because of wear. In this experiment, the toner image 8 is formed by the oilless toner, and accordingly the stripper finger and the releasing agent are not used. As a result, it is confirmed that there is no inconvenience that the releasing layer 5 is debonded from the core 3 before its life expires even though the adhesive force is reduced as described above because of lack of roughening process on the peripheral surface of the core 3. Furthermore, the rate of occurrence of wrinkling in the recording sheet 9 is 1% or less (see FIG. 1 ), so, there is no problem in practice.

To make comparison, another experiment is carried out, in which the ordinary toner and the heat roller 1 having 1 mm thickness are used, three stripper fingers are disposed at approximate regular intervals, the load applied between the heat roller 1 and the pressure roller 2 is set to be 8 kgf, and 4 mg of silicone oil of 100 cs viscosity is supplied per one recording sheet as the releasing agent. As a result of this experiment, the releasing layer 5 is stripped by the center stripper finger at the time when approximately 80,000 recording sheets have passed. Therefore, it is confirmed that the releasing layer 5 is not debonded from the core 3 before its life expires though the surface roughening process is not provided on the peripheral surface of the core 3 on condition that the load applied between the heat roller 1 and the pressure roller 2 is 5 kgf or less, the toner image 8 is formed with the oilless toner, and neither stripper fingers nor releasing agent is used.

Second Embodiment

Figure 7A:
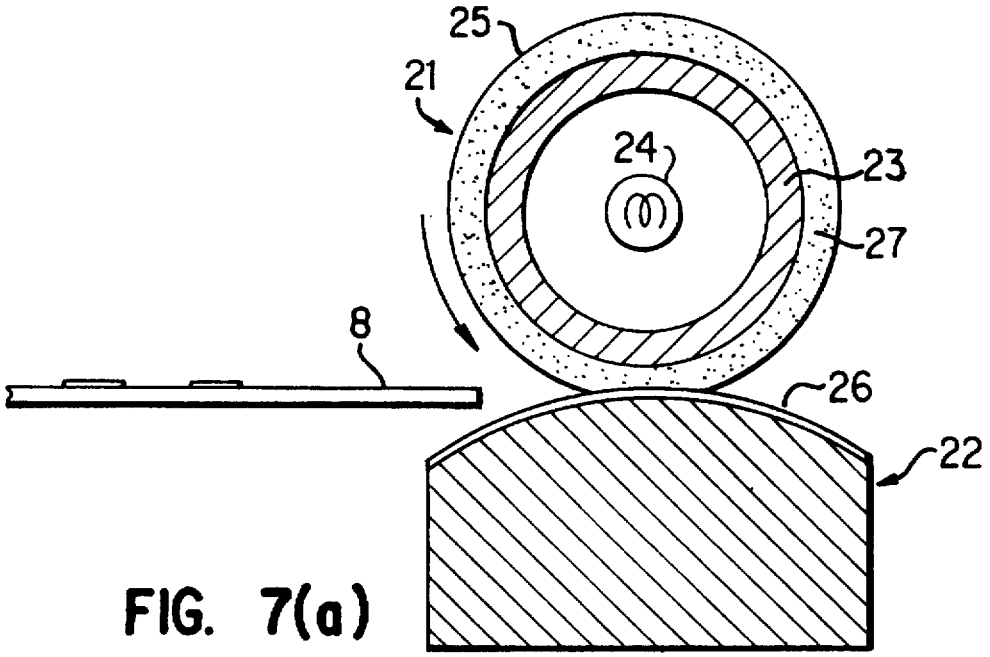
FIGS. 7(*a*)–7(*b*) and 7(*c*) are schematic construction views showing a second embodiment of the image fixing device according to the present invention and a view showing a shape of the nip area formed between the heat roller and the pressure applying means in the second embodiment, respectively.
Figure 7B:
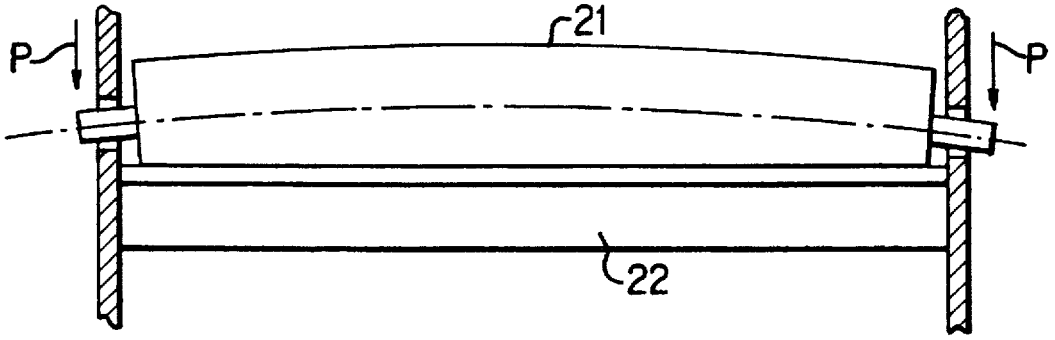
Figure 7C:
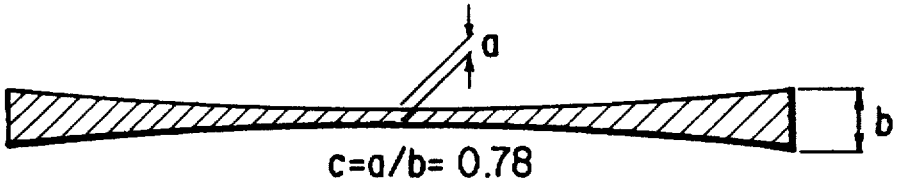

FIG. 7(*a*) is a schematic construction view showing another embodiment of the image fixing device according to the present invention.

The image fixing device has a heat roller 21 supported at both end portions and rotationally driven, a pressure applying member 22 fastened to be supported and press-contacted against to the heat roller 21, whereby a recording sheet 8 forwarded between the heat roller 21 and the pressure applying member 22 is passed through while heat and pressure are applied thereto.

The heat roller 21 has a heater 24 inside a core 23, an elastic material layer 27 on the peripheral surface of the core 23, and a releasing layer 25 formed on the elastic material layer 27. The core 23 is formed by extruding an aluminum and has a uniform outer diameter. The elastic material layer 27 is made of silicone rubber and the releasing layer 25 is dip-coated silicone RTV rubber of 30 μm thickness.

The heater 24 is a 100 V–300 W infrared ray lamp which heats the heat roller from inside. The surface temperature of the heat roller is constantly measured by a temperature sensor (not shown in the figure), and on-off control of the heater 24 is performed so that the surface temperature is maintained to be 150° C.

The pressure applying member 22 has an almost even section in the axial direction of the heat roller 21, and a surface of a portion in contact with the heat roller 21 is curved so that a recording sheet is easily passed. Since the curved surface is rubbed by the recording sheet, a layer 26 for reducing the friction, for example, a fluororesin layer, is formed thereon.

In such image fixing device, if the heat roller 21 supported at both end portions is press-contacted against to the pressure applying member 22, the heat roller is bent by a press-contact force P as shown in FIG. 7(*b*). Then, the elastic material layer 27 of the heat roller 21 is compressed and deformed; therefore the shape of a nip area is as shown in FIG. 7(*c*). Accordingly, compressional deformation of the elastic material layer 27 is larger at both end portions than that at the central portion. For this reason, with respect to the peripheral velocity of the surface of the heat roller 21, the peripheral velocity v of press-contact portion is larger than the peripheral velocity vo of the other portion, and moreover, the peripheral velocity ve of both end portions of the heat roller 21 in its axial direction is larger than the peripheral velocity vc of the central portion. The nip area shape index C, which is closely related to the difference of the peripheral velocity, is 0.78 when the press-contact force is 3 kgf in this embodiment.

In the above-described state, an experiment in which a toner image is fixed on the PPC recording sheet (the recording sheet for a plain paper copying machine) is carried out on similar conditions as those in the first embodiment, which results in that the rate of occurrence of wrinkling is 0.

By using aluminum samples of different surface roughness, the adhesive force between the silicone RTV rubber which is a material of the releasing layer 5 and the aluminum sample which is a material of the core 3 is measured, where conditions of measurement are the same as those of the first embodiment. The result is shown in Table 4.

TABLE 4

| Roughness of the surface of sample (μm) | Adhesive force of silicone RTV rubber (kgf) |
|---|---|
| 0.2 | 0.5 |
| 1.0 | 0.6 |
| 4.0 | 0.8 |

As shown in table 4, the adhesive force between silicone RTV rubber and the aluminum sample of 0.2 μm of surface roughness (10 point average surface roughness Rz), which is almost like a mirror surface, is 0.5 kgf, smaller than the adhesive force in the case where fluororesin is used (see Table 3). Therefore, it is also expected in this case that the adhesive force between the releasing layer 5 and the core 3 is comparatively small.

However, an experiment such that with the heat roller 1 press-contacted against to the heat-resisting and elastic press-contact member 11 with the load of 5 kgf or less, a toner image 8 is formed with oilless toner and copying for 50,000 recording sheets 9 is carried out, and there occurs no debonding of silicone RTV rubber. The number of sheets, 50,000, is the number at which parts of the releasing layer 5 made of silicone RTV rubber corresponding to the end portions of the recording sheet 9 are wear out and difference occurs in level of the releasing layer 5 which results in undesirable printing in the image. The number corresponds to the practical life of the releasing layer 5. Thereby the releasing layer 5 is not debonded from the core 3 until the life of the releasing layer 5 made of silicone RTV rubber expires. Accordingly, it is confirmed that there is no inconvenience such that the releasing layer 5 is debonded from the core 3 before the life of the releasing layer 5 expires though the peripheral surface of the core 3 is not processed with the surface roughening process, on condition that the load applied between the heat roller 1 and the heat-resisting and elastic press-contact member 11 is 5 kgf or less, the toner image 8 is formed with the oilless toner, and neither stripper fingers nor releasing agent is used.

As described above, according to the image fixing device of the present invention, occurrence of wrinkling in the recording sheet can be prevented by controlling the nip area shape index C to be 0.7 to 0.8 though the heat roller has the uniform outer diameter, not be tapered, in the case of comparatively short heat roller. So, it is possible to prevent occurrence of wrinkling without using a so-called reversed crown roller which costs so much in manufacturing, and therefore reduction of manufacturing cost of the image fixing device can be realized.

Moreover, according to the image fixing device of the present invention, it is possible to reduce wear of the releasing layer by diminishing the force applied to the nip area. Furthermore, since formation of the toner image with oilless toner makes it unnecessary to use the stripper fingers and the releasing agent such as silicone oil which deteriorate the releasing layer, debonding of the releasing layer from the core before the life of the releasing layer expires can be prevented without surface roughening process which is expensive and requires much labor in the case where the cylindrical core having uniform outer diameter directly coated with the releasing layer is used as the heat roller.

The foregoing description of preferred embodiments of this invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image fixing device for fixing toner on a transfer member, comprising:

a heat roller which is a hollow cylindrical member rotatably supported at both end portions and having heating means inside thereof;

pressure means press-contacted to said heat roller for pressing said transfer member passing between said heat roller and said pressure means against to a peripheral surface of said heat roller;

said pressure means being a pressure roller disposed approximately parallel to said heat roller and supported rotatably, at least one of said heat roller and said pressure roller having a layer of elastic material on its peripheral surface; and a value A/B being set to be within a range from 0.7 to 0.8, wherein A represents a nip width at an approximate central portion of an area between said heat roller and said pressure roller where said transfer member passes through and B represents a nip width at end portions of said area.

2. The image fixing device according to claim 1, wherein a press-contact force between said heat roller and said pressure roller is set to be not more than 250 g/cm in the direction of an axis of said heat roller.

3. The image fixing device according to claim 1, wherein length of an area in the axial direction of said heat roller where said transfer material passes through is not more than 220 mm.

4. The image fixing device according to claim 2, wherein length of an area in the axial direction of said heat roller where said transfer material passes through is not more than 220 mm.

5. An image fixing device for fixing toner on a transfer member, comprising:

a heat roller which is a hollow cylindrical member rotatably supported at both end portions and having heating means inside thereof;

pressure means press-contacted to said heat roller for pressing said transfer member passing between said heat roller and said pressure means against a peripheral surface of said heat roller;

said pressure means being rubbed by the peripheral surface of said heat roller as said heat roller rotates;

said heat roller having a layer of elastic material on its peripheral surface; and a value A/B being set to be within a range from 0.7 to 0.8, wherein A represents a nip width at an approximate central portion of an area between said heat roller and said pressure roller where said transfer member passes through and B represents a nip width at end portions of said area.

6. The image fixing device according to claim 5, wherein a press-contact force between said heat roller and said pressure roller is set to be not more than 250 g/cm in the direction of an axis of said heat roller.

7. The image fixing device according to claim 5, wherein length of an area of said heat roller in the axial direction where said transfer material passes through is not more than 220 mm.

8. The image fixing apparatus according to claim 6, wherein length of an area of said heat roller in the axial direction where said transfer material passes through is not more than 220 mm.

9. An image fixing method in which a transfer member on which an unfixed toner image is formed is passed between a heat roller and pressure means to fix the toner image on said transfer member, comprising the steps of:

using oilless toner in forming said toner image;

using a heat roller which comprises a cylindrical core having a uniform outer diameter over the longitudinal direction and a releasing layer formed directly on a peripheral surface thereof;

defining that A represents a nip width approximately at a central portion of an area between said heat roller and said pressure means where said transfer member passes through and B represents a nip width at end portions of said area, and setting a value of A/B to be within a range from 0.7 to 0.8; and setting a press-contact force between said heat roller and said pressure means to be not more than 250 g/cm in the axial direction of said heat roller.

10. The image fixing method according to claim 9, wherein length of an area of said heat roller in the axial direction where said transfer material passes through is not more than 220 mm.

11. The image fixing method according to claim 9, wherein said pressure means is a pressure roller.

12. The image fixing method according to claim 10, wherein said pressure means is a pressure roller.

* * * * *

UNITED STATES PATENT AND TRADEMARK OFFICE

CERTIFICATE OF CORRECTION

PATENT NO. : 5,546,175

DATED : August 13, 1996

INVENTOR(S) : Yasuhiro Uehara; Yasuhiro Kusumoto; Yoshio Kanesawa

It is certified that error appears in the above-indentified patent and that said Letters Patent is hereby corrected as shown below:

On the title page;
item [30] Foreign Application Priority Data

Sep. 20, 1994 [JP] Japan .....6-225312
Sep. 13, 1995 [JP] Japan .....7-259487

Signed and Sealed this

Eleventh Day of February, 1997

Bruce Lehman

BRUCE LEHMAN

*Commissioner of Patents and Trademarks*

*Attest:*

*Attesting Officer*